US012631359B2

(12) United States Patent
Hermann et al.

(10) Patent No.: US 12,631,359 B2
(45) Date of Patent: May 19, 2026

(54) INTELLIGENT ENVIRONMENTAL AIR MANAGEMENT SYSTEM

(71) Applicant: Carrier Corporation, Palm Beach Gardens, FL (US)

(72) Inventors: Theodore Hermann, Eden Prairie, MN (US); Bryan M. Yarde, Fort Wayne, IN (US); Benjamen D. Baker, New Haven, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 432 days.

(21) Appl. No.: 17/875,853

(22) Filed: Jul. 28, 2022

(65) Prior Publication Data

US 2023/0031655 A1 Feb. 2, 2023

Related U.S. Application Data

(60) Provisional application No. 63/226,929, filed on Jul. 29, 2021.

(51) Int. Cl.

| | |
|---|---|
| ***F24F 11/63*** | (2018.01) |
| ***F24F 11/52*** | (2018.01) |
| *F24F 110/64* | (2018.01) |
| *F24F 110/66* | (2018.01) |
| *F24F 110/68* | (2018.01) |
| *F24F 110/70* | (2018.01) |
| *F24F 110/72* | (2018.01) |

(52) U.S. Cl.

CPC ..... *F24F 11/63* (2018.01); *F24F 11/52* (2018.01); *F24F 2110/64* (2018.01); *F24F 2110/66* (2018.01); *F24F 2110/68* (2018.01); *F24F 2110/70* (2018.01); *F24F 2110/72* (2018.01)

(58) Field of Classification Search

None

See application file for complete search history.

(56) References Cited

U.S. PATENT DOCUMENTS

| | | | |
|---|---|---|---|
| 7,302,313 | B2 | 11/2007 | Sharp et al. |
| 7,331,852 | B2 | 2/2008 | Ezell et al. |
| 7,434,413 | B2 | 10/2008 | Wruck |
| 7,979,163 | B2 | 7/2011 | Terlson et al. |
| 8,160,729 | B2 | 4/2012 | Ahmed |
| 8,544,288 | B2 | 10/2013 | Macdonald |

(Continued)

FOREIGN PATENT DOCUMENTS

| | | | |
|---|---|---|---|
| CN | 102393882 | B | 11/2014 |
| CN | 205481575 | U | 8/2016 |

(Continued)

OTHER PUBLICATIONS

Extended European Search Report for European Patent Application No. 22187870.5, dated Dec. 5, 2022, 14 pages.

*Primary Examiner* — Paul B Yanchus, III

(74) *Attorney, Agent, or Firm* — Souad Hakim

(57) ABSTRACT

A central controller for an intelligent environmental air management system includes at least one processor and memory storing instructions executable by the at least one processor. The instructions, when executed, cause the central controller to detect and communicate with an air hazard sensor, an environmental condition monitor, and an air hazard mitigation device of the intelligent environmental air management system.

20 Claims, 3 Drawing Sheets

(56) References Cited

U.S. PATENT DOCUMENTS

| | | | | |
|---|---|---|---|---|
| 8,560,126 | B2 | 10/2013 | Trojanova et al. | |
| 8,988,232 | B1 | 3/2015 | Sloo et al. | |
| 9,347,678 | B2 | 5/2016 | Stakutis et al. | |
| 9,810,441 | B2 | 11/2017 | Dean-Hendricks et al. | |
| 10,211,999 | B2 | 2/2019 | Pelton et al. | |
| 10,253,995 | B1 | 4/2019 | Grant | |
| 10,304,319 | B2 | 5/2019 | Sager et al. | |
| 10,347,112 | B2 | 7/2019 | Myllymäki | |
| 10,404,775 | B2 | 9/2019 | Seaton et al. | |
| 10,452,061 | B2 | 10/2019 | Yenni et al. | |
| 10,509,377 | B2 | 12/2019 | Willette et al. | |
| 10,601,603 | B1 | 3/2020 | Vijayakumari Mahasenan et al. | |
| 10,712,038 | B2 | 7/2020 | Ribbich et al. | |
| 10,712,722 | B2 | 7/2020 | Pillai et al. | |
| 10,760,803 | B2 | 9/2020 | Pham et al. | |
| 10,767,879 | B1 | 9/2020 | Burnett | |
| 10,837,665 | B2 | 11/2020 | Ajax et al. | |
| 10,866,007 | B2 | 12/2020 | Paddock et al. | |
| 10,907,844 | B2 | 2/2021 | Ribbich et al. | |
| 10,928,084 | B2 | 2/2021 | Ajax et al. | |
| 10,928,842 | B2 | 2/2021 | Pillai et al. | |
| 2005/0156731 | A1* | 7/2005 | Chapman, Jr. | F24F 11/58 340/521 |
| 2008/0014857 | A1 | 1/2008 | Spadafora et al. | |
| 2008/0182506 | A1 | 7/2008 | Jackson et al. | |
| 2010/0006660 | A1* | 1/2010 | Leen | F24F 11/38 236/51 |
| 2010/0106314 | A1* | 4/2010 | Grohman | F24F 11/62 700/276 |
| 2014/0188287 | A1 | 7/2014 | Sabata | |
| 2015/0140919 | A1 | 5/2015 | Zwijack | |
| 2016/0091471 | A1* | 3/2016 | Benn | G01W 1/00 702/24 |
| 2016/0116181 | A1 | 4/2016 | Aultman et al. | |
| 2016/0290673 | A1 | 10/2016 | Park et al. | |
| 2016/0292781 | A1 | 10/2016 | Nahmad et al. | |
| 2016/0313041 | A1* | 10/2016 | Pham | F25B 49/005 |
| 2018/0163987 | A1 | 6/2018 | Rackes et al. | |
| 2018/0299150 | A1 | 10/2018 | Ajax et al. | |
| 2019/0346170 | A1 | 11/2019 | Benefield | |
| 2020/0088439 | A1 | 3/2020 | Bhosale et al. | |
| 2020/0219375 | A1* | 7/2020 | Peros | G08B 27/00 |
| 2020/0224910 | A1 | 7/2020 | Bloemer et al. | |
| 2020/0224915 | A1 | 7/2020 | Nourbakhsh et al. | |
| 2020/0393152 | A1 | 12/2020 | Ramirez et al. | |
| 2021/0041118 | A1 | 2/2021 | Morgan et al. | |
| 2021/0041119 | A1 | 2/2021 | Pham et al. | |
| 2021/0088247 | A1 | 3/2021 | Kriss | |
| 2021/0116144 | A1 | 4/2021 | Morgan et al. | |
| 2022/0042694 | A1* | 2/2022 | He | F24F 11/30 |

FOREIGN PATENT DOCUMENTS

| | | | |
|---|---|---|---|
| CN | 105933432 | A | 9/2016 |
| CN | 206057868 | U | 3/2017 |
| EP | 3064845 | B1 | 1/2021 |
| EP | 3781878 | A1 | 2/2021 |
| WO | 2016045944 | A1 | 3/2016 |
| WO | 2017121107 | A1 | 7/2017 |
| WO | 2019204788 | A1 | 10/2019 |
| WO | 2019204792 | A1 | 10/2019 |
| WO | 2021011589 | A1 | 1/2021 |

* cited by examiner

INTELLIGENT ENVIRONMENTAL AIR MANAGEMENT SYSTEM

REFERENCE TO RELATED APPLICATION

This application claims the benefit of the U.S. Provisional Patent Application No. 63/226,929, filed Jul. 29, 2021, entitled "INTELLIGENT ENVIRONMENTAL AIR MANAGEMENT SYSTEM" by Theodore Hermann, Bryan Yarde, and Benjamen Baker.

BACKGROUND

The present description relates generally to air management systems, and more particularly to an intelligent environmental air management system.

Buildings such as residential homes contain many devices to monitor different aspects of indoor air quality. However, conventional air management systems do not coordinate indoor air quality management across these devices. This layout makes effective user control difficult due to the decentralized nature of these different devices.

SUMMARY

Accordingly to one aspect of the present invention, a central controller for an intelligent environmental air management system that includes at least one air hazard sensor, at least one environmental condition monitor, and at least one hazard mitigation device is provided. The central controller includes at least one processor and memory storing instructions executable by the at least one processor. The instructions, when executed, cause the central controller to detect and communicate with at least one air hazard sensor, at least one environmental condition monitor, and at least one air hazard mitigation device.

According to another aspect of the present invention, an intelligent environmental air management system for a building includes a central controller, at least one air hazard sensor, at least one environmental condition monitor, and at least one air hazard mitigation device. The at least one air hazard sensor is configured to communicate air hazard data to the central controller. The at least one environmental condition monitor is configured to communicate environmental condition data to the central controller. The at least one air hazard mitigation device is configured to perform at least one air hazard mitigation instruction from the central controller.

According to yet another aspect of the present invention, a method of operating an intelligent environmental air management system includes detecting, with a central controller, a plurality of components of the intelligent environmental air management system. The plurality of components includes at least one air hazard sensor, at least one environmental condition monitor, and at least one air hazard mitigation device. The at least one air hazard sensor measures an air hazard level of at least one air hazard. The at least one air hazard sensor communicates air hazard data to the central controller. The at least one environmental condition monitor measures an environmental condition level of at least one environmental condition. The at least one environmental condition monitor communicates environmental condition data to the central controller. The central controller determines whether the air hazard level of the at least one air hazard exceeds an air hazard threshold for the at least one air hazard.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way.

DETAILED DESCRIPTION

An intelligent environmental air management system combines monitoring and mitigation measures to allow for user control across the available monitoring and mitigation devices in a building. The system can prioritize hazards detected and implement mitigation measures. The system can monitor available devices through wired or wireless networks and adapt mitigation measures accordingly.

Figure 1:
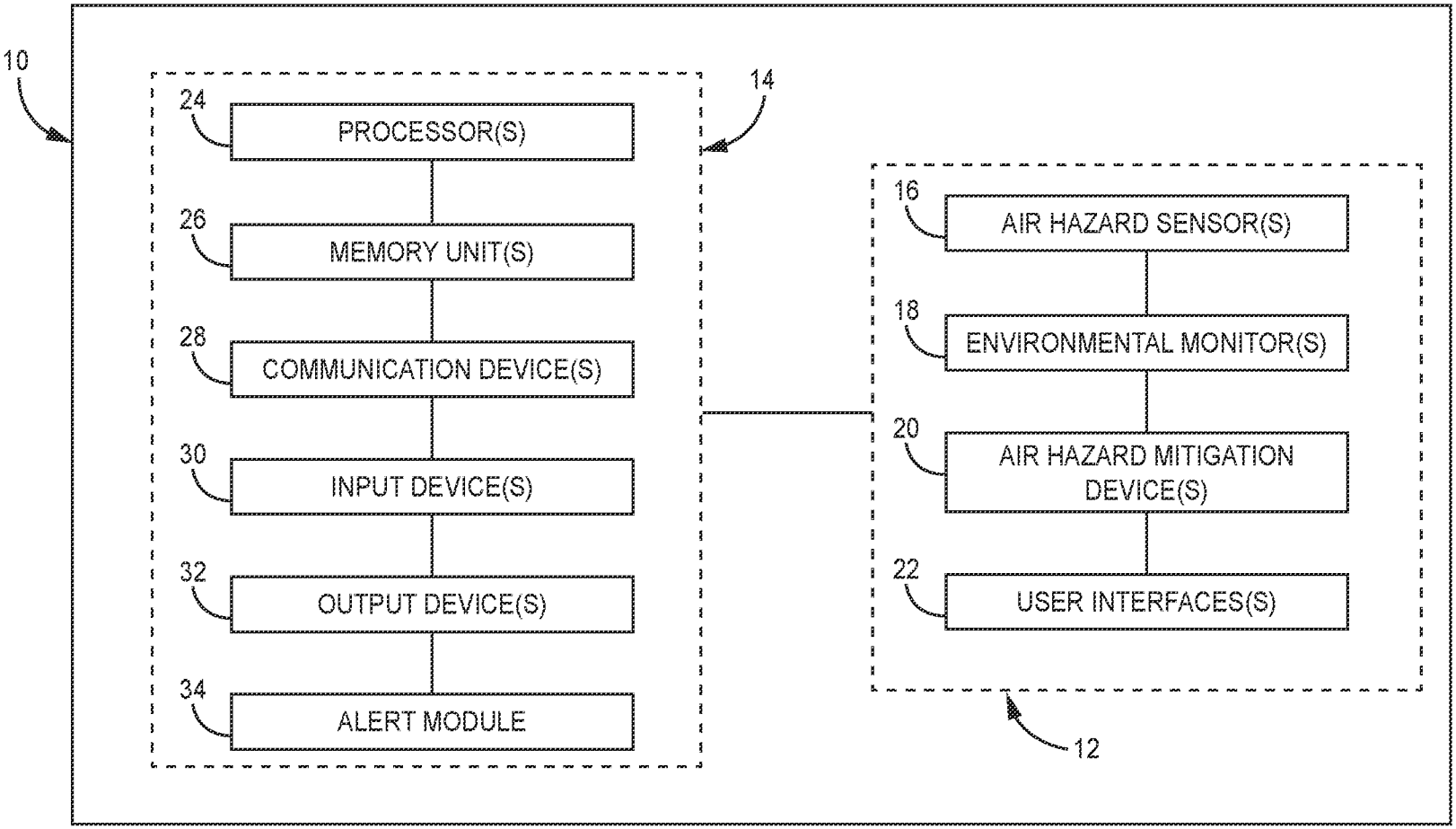
FIG. 1 is a schematic depiction of an exemplary intelligent environmental air management system.

FIG. 1 is a schematic view of exemplary air management system 10. In the depicted example, air management system 10 includes mitigation/monitoring system 12 and central controller 14. Mitigation/monitoring system 12 includes air hazard sensor 16, environmental condition monitor 18, air hazard mitigation device 20, and user interface 22. Central controller 14 includes processor 24, memory unit 26, communication device 28, input device 30, output device 32, and alert module 34. As described in more detail below, air management system 10 is an intelligent environmental air management system for a building.

Mitigation/monitoring system 12 can contain at least one air hazard sensor 16, and in some embodiments can contain multiple air hazard sensors 16. Each air hazard sensor 16 is configured to detect the presence of at least one air hazard. It should be understood that an air hazard is a harmful substance which can be present in the air. An air hazard sensor 16 can be, for example, a carbon dioxide ($CO_2$) sensor, a volatile organic compounds (VOC) sensor, a carbon monoxide (CO) sensor, a smoke detector, or a radon sensor. Each air hazard sensor 16 can be configured to measure an air hazard level of the substance(s) the air hazard sensor 16 is configured to detect. For example, a CO sensor can be configured to measure a CO level. Each air hazard sensor 16 can be further configured to communicate air hazard data to the central controller 14 indicative of the measured air hazard level. Mitigation/monitoring system 12 can include multiple different kinds of air hazard sensors 16, such as, for example, a carbon dioxide sensor and a VOC sensor. Mitigation/monitoring system 12 can additionally and/or alternatively include multiples of the same kind of air hazard sensor 16, such as, for example, three smoke detectors.

Mitigation/monitoring system 12 can include at least one environmental condition monitor 18, and in some embodiments can contain multiple environmental condition monitors 18. Each environmental condition monitor 18 is configured to detect at least one environmental condition, such as temperature or humidity. An environmental condition monitor 18 can be, for example, a temperature sensor or a humidity sensor. Each environmental condition monitor 18 can be configured to measure an environmental condition level of the environmental condition(s) the environmental condition monitor 18 is configured to detect. Each environmental condition monitor 18 can be further configured to communicate environmental condition data to the central controller 14 indicative of the measured environmental condition level. Mitigation/monitoring system 12 can include multiple different kinds of environmental condition monitors 18, and can additionally and/or alternatively include multiples of the same kind of environmental condition monitor 18.

Mitigation/monitoring system 12 can include at least one air hazard mitigation device 20. Each air hazard mitigation device 20 is configured to perform at least one air hazard mitigation measure. An air hazard mitigation device 20 can be, for example, an air exchanger, an in-room air purifier, an exhaust fan, or a furnace blower. Each air hazard mitigation device 20 can be configured to communicate with the central controller 14 such that each air hazard mitigation device 20 can receive at least one air hazard mitigation instruction from central controller 14 to perform the at least one air hazard mitigation measure. In addition, each air hazard mitigation device 20 can be configured to communicate with the central controller 14 such that each air hazard mitigation device 20 can send to the central controller 14 information about the operation of the air hazard mitigation device 20. Mitigation/monitoring system 12 can include multiple different kinds of air hazard mitigation devices 20, and can additionally and/or alternatively include multiples of the same kind of air hazard mitigation devices 20.

Mitigation/monitoring system 12 can include at least one user interface 22. Each user interface 22 can be configured to receive input from a user. A user interface 22 can be, for example, a wall control device such as a thermostat, a voice control device such as a digital assistant, a remote control device, a computer-based application, or a mobile phone application. Each user interface 22 can be configured to communicate with the central controller 14. As described in more detail below, each user interface 22 can be further configured to receive a user's selection of an operating mode of the air management system 10. Mitigation/monitoring system 12 can include multiple different kinds of user interfaces 22, and can additionally and/or alternatively include multiples of the same kind of user interface 22. In some examples, user interface 22 can include the input device 30 and/or output device 32 described below. In other examples, user interface 22 can be configured to communicate with input device 30 and/or output device 32 within central controller 14.

As described above, central controller 14 can include processor 24, memory unit 26, communication device 28, input device 30, output device 32, and alert module 34. In some embodiments, controller 14 can include multiple processors 24, memory units 26, communication devices 28, input devices 30, and output devices 32. Central controller 14 can additionally include more components, such as a power source.

Processor 24 can be configured to implement functionality and/or process instructions for execution within central controller 14. For example, processor 24 can be capable of processing instructions stored in memory unit 26. Examples of processor 24 can include any one or more of a microprocessor, a controller, a digital signal processor (DSP), an application specific integrated circuit (ASIC), a field-programmable gate array (FPGA), or other equivalent discrete or integrated logic circuitry. Instructions executed by processor 24 can cause central controller 14 to perform actions, such as detect and communicate with the components of mitigation/monitoring system 12, receive and assess input data from the components, and/or direct the components to perform actions.

Central controller 14 can also include memory capable of storage, such as memory unit 26. Memory unit 26 can be configured to store information (and/or instructions which may be executable by processor 24) within central controller 14 during operation. Memory unit 26, in some examples, is described as a computer-readable storage medium. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, memory unit 26 is a temporary memory, meaning that a primary purpose of memory unit 26 is not long-term storage. Memory unit 26, in some examples, is described as volatile memory, meaning that memory unit 26 does not maintain stored contents when power to central controller 14 is turned off. Examples of volatile memories can include random access memories (RAM), dynamic random access memories (DRAM), static random access memories (SRAM), and other forms of volatile memories. In some examples, memory unit 26 is used to store program instructions for execution by processor 24.

Memory unit 26 can be configured to store larger amounts of information than volatile memory. Memory unit 26 can further be configured for long-term storage of information. In some examples, memory unit 26 includes non-volatile storage elements. Examples of such nonvolatile storage elements can include magnetic hard discs, optical discs, flash memories, or forms of electrically programmable memories (EPROM) or electrically erasable and programmable (EEPROM) memories.

Central controller 14 can also include communication device 28. Central controller 14 can utilize communication device 28 to communicate with devices via one or more networks, such as one or more wireless or wired networks or both. Communication device 28 can be a network interface card, such as an Ethernet card, an optical transceiver, a radio frequency transceiver, or any other type of device that can send and receive information. For example, communication device 28 can be a radio frequency transmitter dedicated to Bluetooth or WiFi bands or commercial networks such as GSM, UMTS, 3G, 4G, 5G, and others. Alternately, communication device 28 can be a Universal Serial Bus (USB).

Central controller 14 can include input device 30. Input device 30 can include a presence-sensitive and/or touch-sensitive display, or other type of device configured to receive input from a user.

Central controller 14 can include output device 32. Output device 32 can include a display device, a speaker, a liquid crystal display (LCD), a light emitting diode (LED) display, an organic light emitting diode (OLED) display, discrete switched outputs, or other type of device for outputting information in a form understandable to users or machines. In examples where central controller 14 is configured to transfer and store data via the cloud, the input device 30 and/or output device 32 can be a host computing system offsite and can use applications to, for example, process user input data.

Central controller 14 can also include alert module 34. Alert module 34 can be configured to direct user interface 22 to display or announce an air hazard warning. Alert module 34 can be further configured to direct user interface 22 and/or the at least one air hazard sensor 16 to display a mitigation failure alarm message or emit an alarm. In examples where user interface 22 can visually display information to a user, alert module 34 can be configured to direct user interface 22 to display a written air hazard warning. In examples where user interface 22 can audibly convey information to a user, alert module 34 can be configured to direct user interface 22 to announce an auditory air hazard warning and/or mitigation failure alarm. In some examples, alert module 34 can be configured to suggest additional air hazard mitigation measures to a user. For example, alert module 34 can be configured to direct user interface 22 to display a message suggesting that a user open a window in their home to more effectively mitigate the air hazard(s) present.

Central controller 14 can be configured to receive input data and direct components to carry out instructions for the operation and configuration of components within air management system 10. For example, central controller 14 can be configured to detect the components of mitigation/monitoring system 12 (air hazard sensor 16, environmental condition monitor 18, air hazard mitigation device 20, and user interface 22). This detection of components can include detecting which components are connected, as well as detecting whether a particular component is operational (i.e. able to communicate with and receive instructions from central controller 14). Central controller 14 can be configured to detect the kind of component that is connected within mitigation/monitoring system 12. For example, central controller 14 can be configured to detect that air hazard sensor 16 is a CO sensor. Central controller 14 can be further configured to detect a location of each of the components of mitigation/monitoring system 12 (air hazard sensor 16, environmental condition monitor 18, air hazard mitigation device 20, and user interface 22). Central controller 14 can be configured to detect a location of at least one person with respect to each of the components of mitigation/monitoring system 12, and can further be configured to detect a number of persons present with respect to the locations of each of the components of mitigation/monitoring system 12. Central controller 14 can be configured to designate zones within the building to allow for targeted air hazard mitigation measures. For example, if central controller 14 receives air hazard data indicating a high VOC level in a zone corresponding to the kitchen, central controller 14 can direct an air hazard mitigation device 20 in the kitchen (such as an air exchanger) to begin operating.

Central controller 14 can be configured to communicate with air hazard sensor 16, environmental condition monitor 18, air hazard mitigation device 20, and user interface 22. This can be accomplished through communication device 28, which can enable central controller 14 to communicate with air hazard sensor 16, environmental condition monitor 18, air hazard mitigation device 20, and user interface 22 over wired or wireless networks. For example, communication device 28 can enable central controller 14 to communicate with the components of mitigation/monitoring system 12 via automated commissioning (for connected smart components), proximity commissioning (using Near Field Commissioning (NFC) or Bluetooth connections), or manual commissioning (wired connections between the components and central controller 14).

Central controller 14 can be configured to receive input data from air hazard sensor 16 and/or environmental condition monitor 18. As described above, input data from air hazard sensor 16 is air hazard data, and input data from environmental condition monitor 18 is environmental condition data. Central controller 14 can be configured to assign a priority level to the input data from air hazard sensor 16 through a prioritization algorithm stored within memory unit 26. The prioritization algorithm can designate a priority level for each air hazard to enable effective air hazard mitigation when multiple air hazards are detected. This can additionally help to avoid exacerbating air hazards by coordinating air hazard mitigation measures. Central controller 14 can be configured to determine whether the air hazard data received from air hazard sensor 16 exceeds an air hazard threshold. An air hazard threshold can be designated for each air hazard based on, for example, indoor air quality standards, manufacturer recommendations, or user selected default levels.

Central controller 14 can be configured to select at least one air hazard mitigation measure if the air hazard data exceeds the air hazard threshold for the relevant air hazard, and can be configured to direct air hazard mitigation device 20 to perform the selected at least one air hazard mitigation measure. The at least one air hazard mitigation measure can be designated by an action algorithm stored within memory unit 26. The action algorithm, in combination with the prioritization algorithm, can designate and store the appropriate air hazard mitigation measures for the air hazard(s) detected. Central controller 14 can further be configured to assess the priority levels of the input data from air hazard sensor 16 and select an air hazard mitigation measure which corresponds to the highest priority level assessed by central controller 14.

Central controller 14 can be configured to select an operating mode of air management system 10. Operating modes of air management system 10 can include, for example, an energy efficiency mode, an optimal air quality mode, and/or a user-customized mode. In an energy efficiency mode, central controller 14 can initially select air hazard mitigation measures which are more thermally efficient than other air hazard mitigation measures. For example, if central controller 14 detects both a high $CO_2$ level and a large temperature difference between indoor and outdoor temperature, central controller 14 can initially select a more energy-efficient air hazard mitigation measure (using a furnace blower to circulate air) over a less energy-efficient air hazard mitigation measure (using an air exchanger to draw in outdoor air). In an optimal air quality mode, central controller 14 can initially select the air hazard mitigation measure which is projected to be the most effective at mitigating the detected air hazard(s), as opposed to the air hazard mitigation measure which is the most energy efficient. A user-customized mode can include selections and input from a user about their preferences. The selection of a particular prioritization and/or action algorithm can be modified based on the selected operating mode.

Central controller 14 can be configured to calculate a rate of change of the air hazard level while the air hazard mitigation device 20 is performing the at least one air hazard mitigation measure. The rate of change can be found by, for example, calculating the change in the level of the air hazard over a period of time as follows:

$$\frac{\Delta H}{\Delta t}$$

where ΔH is the difference between a first measured air hazard level and a second measured air hazard level, and Δt is the amount of time between a first air hazard level measurement and a second air hazard level measurement.

Central controller 14 can be configured to direct air hazard mitigation device 20 to perform an air hazard mitigation measure at a variable speed based on the rate of change of the air hazard level. For example, if the air hazard level has not yet been mitigated by the air hazard mitigation measure, central controller 14 can direct air hazard mitigation device 20 to operate at a higher level in order to mitigate the air hazard. If the air hazard level is approaching a safe level, central controller 14 can direct air hazard mitigation device 20 to operate at a lower level.

In some examples, central controller 14 can be configured to assess whether an air hazard level is projected to exceed the air hazard threshold for that particular air hazard using the calculated rate of change of the air hazard. Central controller 14 can be further configured to direct air hazard mitigation device 20 to perform an air hazard mitigation measure in order to prevent the air hazard level of the air hazard from exceeding the air hazard threshold.

Central controller 14 can be configured to assess whether the air hazard level of an air hazard has dropped to below the air hazard threshold and reached a safe level. The safe level can be, for example, defined by indoor air quality standards, and can alternatively be a baseline level (defined by an average measurement, such as a 90 day running average within the building). The central controller 14 can be configured to direct air hazard mitigation device 20 to suspend the air hazard mitigation measure once the air hazard level is at or below the safe level.

Central controller 14 can be a modular component such that central controller 14 is a separate device from the rest of air management system 10, and in some examples central controller 14 can be a portable device. Central controller 14 can be a localized controller that receives input from, and sends instructions to, the components of mitigation/monitoring system 12.

Figure 2:
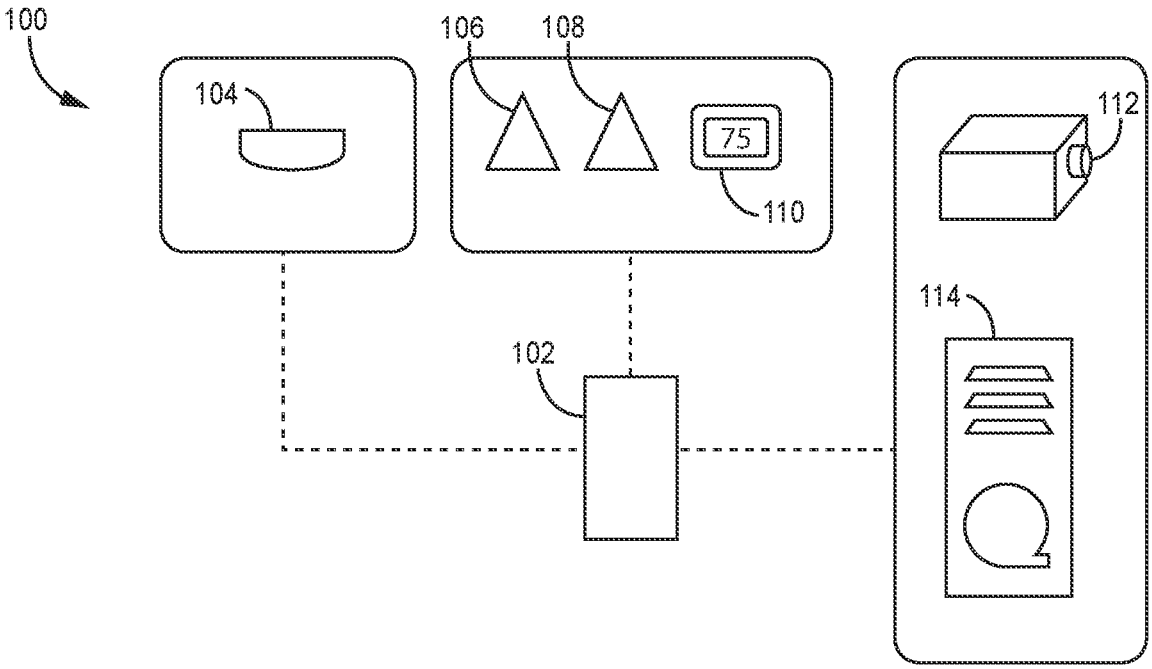
FIG. 2 is a schematic depiction of an exemplary intelligent environmental air management system which includes a carbon dioxide sensor, an air exchanger, and a furnace blower.

FIG. 2 is a schematic view of exemplary air management system 100. Air management system includes central controller 102, carbon dioxide sensor 104, outdoor air temperature sensor 106, HVAC return air temperature sensor 108, indoor air temperature sensor 110, air exchanger 112, and furnace blower 114.

$CO_2$ sensor 104 can be configured to measure a $CO_2$ level and communicate $CO_2$ data to central controller 102. Outdoor air temperature sensor 106 can be configured to measure the outdoor air temperature and communicate outdoor air temperature data to central controller 102. HVAC return air temperature sensor 108 can be configured to measure the HVAC return air temperature and communicate HVAC return air temperature data to central controller 102. Indoor air temperature sensor 110 can be configured to measure the indoor air temperature and communicate indoor air temperature data to central controller 102. Air management system 100 functions in substantially the same way as air management system 10 described above in reference to FIG. 1.

Figure 3:
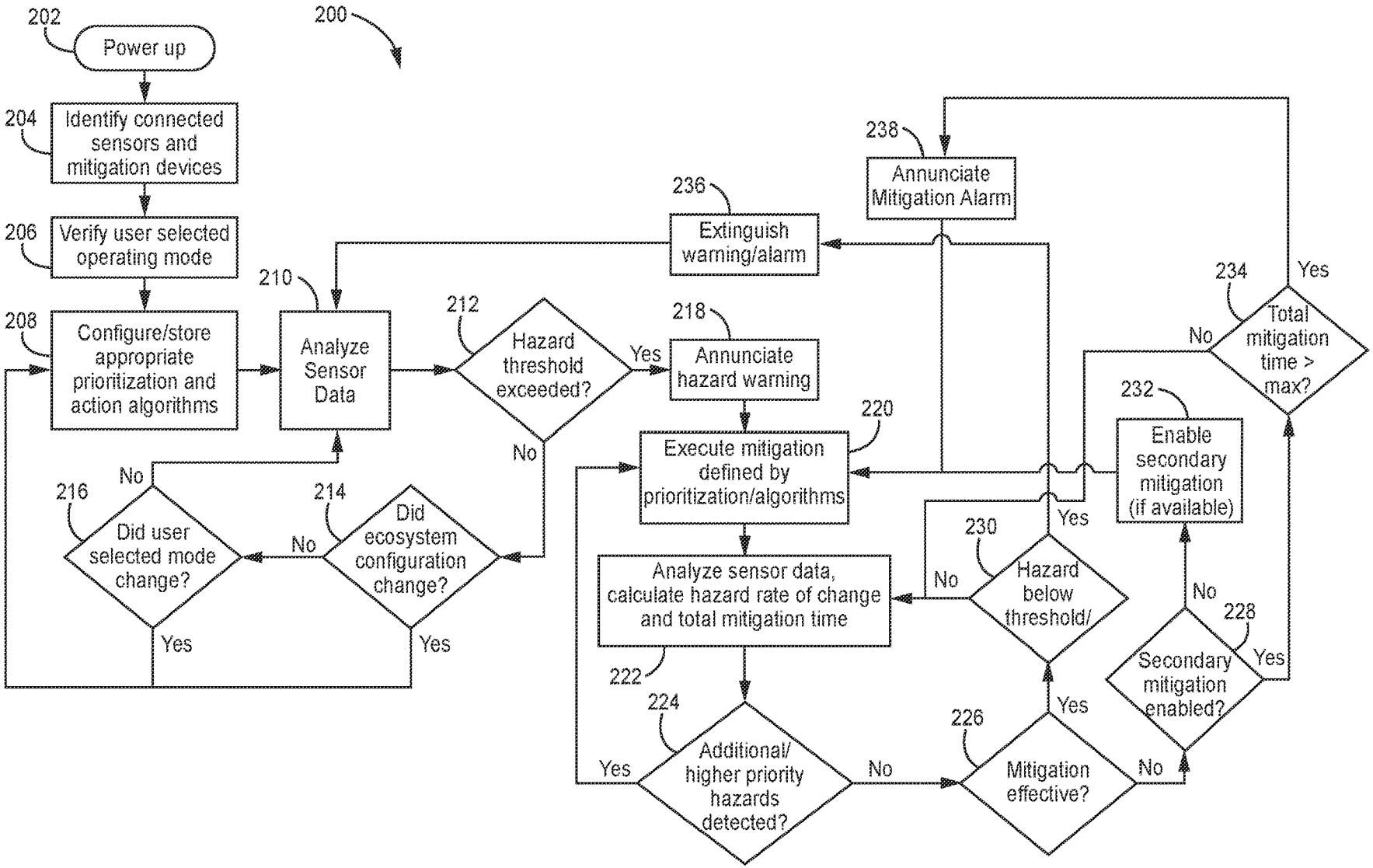
FIG. 3 is a flow chart depicting an exemplary operation of an intelligent environmental air management system.

FIG. 3 is a flow chart depicting a method 200 of operating of an air management system, such as air management systems 10 and 100. Method 200 can include steps 202-238.

In step 202, the air management system can be powered on. This can be accomplished by, for example, a user powering on the air management system or the central controller directing the air management system to power on at a preselected time. Powering on can additionally and/or alternatively occur after a shutdown, such as in the case of a system reboot, or an event such as power loss.

In step 204, a central controller of the air management system can identify components of a mitigation/monitoring system of the air management system. As described above in reference to FIG. 1, these components can include at least one air hazard sensor, at least one environmental condition monitor, at least one air hazard mitigation device, and at least one user interface. The at least one air hazard sensor can be a carbon dioxide sensor, a total volatile organic compounds sensor, a carbon monoxide sensor, a smoke detector, and/or a radon sensor. The at least one environmental condition monitor can be a temperature sensor and/or a humidity sensor. The at least one air hazard mitigation device can be an air exchanger, an in-room air purifier, an exhaust fan, and/or a furnace blower. The at least one user interface can be a wall control device, a voice control device, a remote control device, a computer-based application, and/or a mobile phone application. As described above in reference to FIG. 1, the central controller can be configured to detect which components are connected and operational. As described in more detail below with respect to step 214, the status of each component (whether the component is connected and/or operable by the central controller) can also be periodically checked throughout the operation of the air management system.

In step 206, a user can select an operating mode of the air management system, and the central controller can verify the operating mode selected by the user. As described above in reference to FIG. 1, the operating mode can be, for example, an energy efficiency mode, an optimal air quality mode, or a user-customized mode.

In step 208, the central controller can configure and store the appropriate prioritization and action algorithms. The central controller can configure the prioritization and/or action algorithms based on, for example, the selected operating mode and/or the configuration of components within the air management system. These algorithms are described in detail above in reference to FIG. 1.

In step 210, the central controller can analyze input data from the components in the mitigation/monitoring system. This can include, for example, air hazard data from the at least one air hazard sensor and/or environmental condition data from the at least one environmental condition monitor.

In step 212, the central controller can assess whether a particular air hazard threshold for each air hazard has been exceeded. If the central controller determines that no air hazard thresholds have been exceeded, the air management system can proceed to step 214. If the central controller determines that a particular air hazard threshold has been exceeded, the air management system can proceed to step 218.

In step 214, the central controller can assess whether the configuration of the air management system has changed since step 204 (in which the central controller identifies the components within the air management system). The central controller can identify, for example, whether a new component has been added, or whether a component has gone offline or is otherwise disconnected from the central controller. The central controller can repeat step 214 periodically during the operation of the air management system. If the central controller determines that the configuration of the air management system has not changed (i.e. all initially detected components are currently connected), the air management system can proceed to step 216. If the central controller determines that the configuration of the air management system has changed, the air management system can repeat steps 208-212 as described above.

In step 216, the central controller can assess whether the operating mode selected by a user in step 206 has changed. If the central controller determines that the initially selected operating mode has not changed, the air management system can repeat steps 210-212 as described above. If the central controller determines that the selected operating mode has changed (i.e. a user has selected a different operating mode, reset or changed the initial operating mode settings, or otherwise changed the initially selected operating mode), the air management system can repeat steps 208-212 as described above.

In step 218, the central controller can direct an alert module to annunciate an air hazard warning. This can be accomplished by, for example, displaying an air hazard warning message on the user interface that an unsafe level of an air hazard has been detected and that the system will begin performing air hazard mitigation measures.

In step 220, the central controller can direct at least one air hazard mitigation devices to execute at least one air hazard mitigation measure. The air hazard mitigation measure can be selected by the central controller based on the air hazard mitigation device(s) detected by the central controller. The air hazard mitigation measure(s) can be defined by the configured prioritization and action algorithms. For example, if a VOC level above the VOC threshold has been detected in a particular room, the central controller can direct an air exchanger to begin operating.

In step 222, the central controller can analyze air hazard data from the connected air hazard sensors. Using this air hazard data, the central controller can calculate the rate of change of the air hazard, and can further calculate the total time needed to mitigate the air hazard (i.e. return to a safe air quality with an air hazard level below the air hazard threshold).

In step 224, the central controller can assess whether additional air hazards have been detected by a connected air hazard sensor. The central controller can further assess whether any additional air hazards detected have a higher priority level than the air hazard initially detected in step 212. If no additional air hazards have been detected, or if additional air hazards detected have a lower priority level than the air hazard initially detected in step 212, the air management system can proceed to step 226. If the central controller determines that an air hazard with a higher priority level than the air hazard detected in step 212 is present, the air management system can repeat steps 220-222 as described above.

In step 226, the central controller can assess whether the at least one air hazard mitigation measure performed by the at least one air hazard mitigation device in step 220 is effectively mitigating the air hazard detected in steps 212 or 224. The central controller can assess the effectiveness of the at least one air hazard mitigation measure by, for example, measuring whether the rate of change calculated in step 222 is negative or positive. A negative rate of change signals that the air hazard level is decreasing over time, while a positive rate of change signals an increase in the air hazard level over time. The central controller can additionally compare the rate of change to a threshold rate of change. This threshold rate of change can be, for example, based on the volume of the building and the possible volume of air exchange. If the central controller measures a positive rate of change, the central controller can designate the at least one air hazard mitigation measure as ineffective and the air management system can proceed to step 228. Additionally and/or alternatively, the central controller can designate the at least one air hazard mitigation measure as ineffective if the rate of change exceeds the threshold rate of change, which would signal that the air hazard level is decreasing less quickly than it would at a threshold rate of change. Conversely, if the central controller measures a negative rate of change, or a rate of change which is less than the threshold rate of change, the central controller can designate the at least one air hazard mitigation measure as effective and the air management system can proceed to step 230.

In step 228, the central controller can assess whether a secondary air hazard mitigation measure is available. This can be accomplished by the central controller determining whether a second air hazard mitigation device is connected or determining whether the air hazard mitigation device currently performing an air hazard mitigation measure can change the air hazard mitigation measure currently being performed. If the central controller determines that a secondary air hazard mitigation measure is available, the central controller can then determine whether the secondary air hazard mitigation measure is currently enabled. If the central controller determines that a secondary air hazard mitigation measure is available and not yet enabled, the air management system can proceed to step 232. If the central controller determines that a secondary air hazard mitigation measure is either unavailable or already enabled, the air management system can proceed to step 234.

In step 230, the central controller can assess whether the air hazard level is above or below the air hazard threshold. If the central controller determines that the air hazard level is above the air hazard threshold, the air management system can repeat steps 222-224. If the central controller determines that the air hazard level is below the air hazard threshold (i.e. that the previously detected air hazard has been mitigated), the air management system can proceed to step 236.

In step 232, the central controller can direct at least one air hazard mitigation device to enable a secondary air hazard mitigation measure. After the central controller directs the at least one air hazard mitigation device to enable the secondary air hazard mitigation measure, the air management system can repeat steps 220-224.

In step 234, the central controller can measure the amount of time that has passed since the at least one air hazard mitigation device began performing the at least one air hazard mitigation measure. The central controller can additionally assess whether the amount of time that has passed exceeds a maximum mitigation time. If the central controller determines that the amount of time has not exceeded the maximum mitigation time, the air management system can repeat steps 222-224. If the central controller determines that the amount of time has exceeded the maximum mitigation time, the air management system can proceed to step 238.

In step 236, the central controller can direct the alert module to extinguish the air hazard warning annunciated by the alert module in step 218. This can be accomplished by, for example, displaying a message on the user interface that the air hazard has been successfully mitigated. The central controller can additionally direct the at least one air hazard mitigation device to suspend the at least one mitigation measure. The air management system can then repeat steps 210-212.

In step 238, the central controller can direct the alert module to trigger a mitigation alarm. This can be accomplished by, for example, displaying a mitigation failure alarm message on the user interface that the air hazard mitigation measures have been unsuccessful, or directing one of the air hazard sensors to emit an audible alarm. The air management system can then repeat steps 220-224.

Incorporating an intelligent environmental air management system into a building provides several advantages. A central controller allows for easy and effective centralized user management of the air management system. A central controller which can detect connected devices can manage device outages or connection problems while allowing the air management system to continue operating. Incorporating prioritization algorithms for the selection of air hazard mitigation measures improves the safety of the system and accounts for the devices detected by the central controller. Finally, an intelligent system allows for personalized settings based on the user's preferences and available devices.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A central controller for an intelligent environmental air management system comprising at least one air hazard sensor, at least one environmental condition monitor, and at least one air hazard mitigation device, the central controller comprising:

at least one processor; and memory storing instructions executable by the at least one processor, wherein the instructions, when executed, cause the central controller to:

detect which of the at least one air hazard sensor, the at least one environmental condition monitor, and the at least one air hazard mitigation device are connected to the intelligent environmental air management system;

detect which of the at least one air hazard sensor, the at least one environmental condition monitor, and the at least one air hazard mitigation device are operational by determining whether the at least one air hazard sensor, the at least one environmental condition monitor, and the at least one air hazard mitigation device can communicate with and receive instructions from the central controller; and detect, for each of the at least one air hazard sensor, the at least one environmental condition monitor, and the at least one air hazard mitigation device, the type of component connected with the central controller;

wherein the instructions further cause the central controller to periodically assess operational status by directing the at least one air hazard mitigation device to execute at least one air hazard mitigation measure, and measuring, by the at least one air hazard sensor, a resulting change in an air hazard value;

wherein for the at least one air hazard sensor the type of component comprises one or more of: a carbon dioxide sensor, a total volatile organic compounds sensor, a carbon monoxide sensor, a smoke detector, and a radon sensor;

wherein for the at least one environmental condition monitor the type of component comprises one or more of: a temperature sensor and a humidity sensor; and wherein for the at least one air hazard mitigation device the type of component comprises one or more of: an air exchanger, an in-room air purifier, an exhaust fan, and a furnace blower.

2. The central controller of claim 1, wherein the instructions further cause the central controller to:

receive input data from the at least one air hazard sensor;

determine whether the input data received from the at least one air hazard sensor exceeds an air hazard threshold;

select the at least one air hazard mitigation measure if the input data received from the at least one air hazard sensor exceeds the air hazard threshold, wherein the at least one hazard mitigation measure is determined by the at least one air hazard mitigation device detected by the central controller; and direct the at least one air hazard mitigation device to perform the at least one air hazard mitigation measure, wherein the central controller is configured to select the at least one air hazard mitigation measure based on an assigned priority level when multiple air hazards are detected.

3. The central controller of claim 2, wherein the instructions, when executed, are further configured to cause the central controller to:

assign a priority level to air hazard data from the at least one air hazard sensor through a prioritization algorithm stored within the memory, wherein the prioritization algorithm is configured to designate a priority level for each air hazard to enable effective air hazard mitigation when multiple air hazards are detected; and select at least one air hazard mitigation measure if the air hazard data exceeds an air hazard threshold for a relevant air hazard and direct an air hazard mitigation device to perform a selected at least one air hazard mitigation measure, wherein the at least one air hazard mitigation measure is designated by an action algorithm stored within the memory;

wherein the action algorithm and the prioritization algorithm are configured to designate and store appropriate air hazard mitigation measures for the detected air hazard;

wherein the selection of a particular prioritization algorithm and/or particular action algorithm is configured to be modified based on a selected operating mode.

4. The central controller of claim 2, wherein the instructions further cause the central controller to:

identify whether a new component has been added to the air management system or whether a previously identified component has gone off line; and if the central controller identifies that a new component has been added to the air management system or previously identified component has gone off line, repeating the steps of that:

detect which of the at least one air hazard sensor, the at least one environmental condition monitor, and the at least one air hazard mitigation device are connected to the intelligent environmental air management system;

detect which of the at least one air hazard sensor, the at least one environmental condition monitor, and the at least one air hazard mitigation device are operational by determining whether the at least one air hazard sensor, the at least one environmental condition monitor, and the at least one air hazard mitigation device can communicate with and receive instructions from the central controller; and detect, for each of the at least one air hazard sensor, the at least one environmental condition monitor, and the at least one air hazard mitigation device, the type of component connected with the central controller.

5. The central controller of claim 2, wherein the instructions further cause the central controller to receive input data from the at least one environmental condition monitor.

6. The central controller of claim 2, wherein the instructions further cause the central controller to detect and communicate with at least one user interface to direct the at least one user interface to display an alert.

7. An intelligent environmental air management system for a building, the intelligent environmental air management system comprising:

the central controller of claim 1;

at least one air hazard sensor, wherein the at least one air hazard sensor is configured to communicate air hazard data to the central controller;

at least one environmental condition monitor, wherein the at least one environmental condition monitor is configured to communicate environmental condition data to the central controller; and at least one air hazard mitigation device, wherein the at least one air hazard mitigation device is configured to perform at least one air hazard mitigation instruction from the central controller.

8. The intelligent environmental air management system of claim 7, wherein the instructions, when executed, are further configured to cause the central controller to:

assign a priority level to air hazard data from the at least one air hazard sensor through a prioritization algorithm stored within the memory, wherein the prioritization algorithm is configured to designate a priority level for each air hazard to enable effective air hazard mitigation when multiple air hazards are detected; and select at least one air hazard mitigation measure if the air hazard data exceeds an air hazard threshold for a relevant air hazard and direct an air hazard mitigation device to perform a selected at least one air hazard mitigation measure, wherein the at least one air hazard mitigation measure is designated by an action algorithm stored within the memory;

wherein the action algorithm and the prioritization algorithm are configured to designate and store appropriate air hazard mitigation measures for the detected air hazard;

wherein the selection of a particular prioritization algorithm and/or particular action algorithm is configured to be modified based on a selected operating mode.

9. The intelligent environmental air management system of claim 7, wherein the intelligent environmental air management system further comprises at least one user interface and the at least one user interface comprises one or more of: a wall control device, a voice control device, a remote control device, a computer-based application, and a mobile phone application.

10. A method of operating an intelligent environmental air management system, the method comprising:

detecting, with a central controller, a plurality of components of the intelligent environmental air management system, the plurality of components comprising at least one air hazard sensor, at least one environmental condition monitor, and at least one air hazard mitigation device;

detecting, with the central controller, which of the at least one air hazard sensor, the at least one environmental condition monitor, and the at least one air hazard mitigation device are operational by determining whether the at least one air hazard sensor, the at least one environmental condition monitor, and the at least one air hazard mitigation device can communicate with and receive instructions from the central controller; and detecting, with the central controller, for each of the at least one air hazard sensor, the at least one environmental condition monitor, and the at least one air hazard mitigation device, the type of component connected with the central controller;

periodically assessing, with the central controller, operational status by directing the at least one air hazard mitigation device to execute at least one air hazard mitigation measure, and measuring, by the at least one air hazard sensor, a resulting change in an air hazard value;

wherein for the at least one air hazard sensor the type of component comprises one or more of: a carbon dioxide sensor, a total volatile organic compounds sensor, a carbon monoxide sensor, a smoke detector, and a radon sensor;

wherein for the at least one environmental condition monitor the type of component comprises one or more of: a temperature sensor and a humidity sensor; and wherein for the at least one air hazard mitigation device the type of component comprises one or more of: an air exchanger, an in-room air purifier, an exhaust fan, and a furnace blower;

measuring, with the at least one air hazard sensor, an air hazard level of at least one air hazard;

communicating, with the at least one air hazard sensor, air hazard data to the central controller;

measuring, with the at least one environmental condition monitor, an environmental condition level of at least one environmental condition;

communicating, with the at least one environmental condition monitor, environmental condition data to the central controller; and determining, by the central controller, whether the air hazard level of the at least one air hazard exceeds an air hazard threshold for the at least one air hazard.

11. The method of claim 10, further comprising:

selecting, with the central controller, the at least one air hazard mitigation measure if the air hazard level of the at least one air hazard exceeds the air hazard threshold for the at least one air hazard, wherein the at least one hazard mitigation measure is determined by the at least one air hazard mitigation device detected by the central controller; and directing the at least one air hazard mitigation device, with the central controller, to perform the at least one air hazard mitigation measure based on an assigned priority level when multiple air hazards are detected.

12. The method of claim 11, further comprising assigning, with the central controller, a priority level based on the air hazard data.

13. The method of claim 12, wherein selecting, with the central controller, at least one air hazard mitigation measure comprises assessing the priority level of the air hazard data and selecting an air hazard mitigation measure which corresponds to the highest priority level assessed by the central controller.

14. The method of claim 11, further comprising calculating, with the central controller, a rate of change of the air hazard level while the air hazard mitigation device is performing the at least one air hazard mitigation measure.

15. The method of claim 11, further comprising:

identifying whether a new component has been added to the air management system or whether a previously identified component has gone off line; and if the central controller identifies that a new component has been added to the air management system or a previously identified component has gone off line, repeating the steps of:

detecting, with the central controller, a plurality of components of the intelligent environmental air management system, the plurality of components comprising at least one air hazard sensor, at least one environmental condition monitor, and at least one air hazard mitigation device;

detecting, with the central controller, which of the at least one air hazard sensor, the at least one environmental condition monitor, and the at least one air hazard mitigation device are operational by determining whether the at least one air hazard sensor, the at least one environmental condition monitor, and the at least one air hazard mitigation device can communicate with and receive instructions from the central controller; and detecting, with the central controller, for each of the at least one air hazard sensor, the at least one environmental condition monitor, and the at least one air hazard mitigation device, the type of component connected with the central controller.

16. The method of claim 10, further comprising selecting an operating mode of the intelligent environmental air management system, wherein the central controller is configured to select the at least one air hazard mitigation measure based on the selected operating mode.

17. The method of claim 16, wherein the operating mode of the intelligent environmental air management system is selected using at least one user interface.

18. The method of claim 17, further comprising displaying an alert with the at least one user interface, wherein the alert is selected from the group comprising: an air hazard warning and a mitigation failure alarm.

19. The method of claim 16, wherein the instructions, when executed, are further configured to cause the central controller to:

assign a priority level to air hazard data from the at least one air hazard sensor through a prioritization algorithm stored within the memory, wherein the prioritization algorithm is configured to designate a priority level for each air hazard to enable effective air hazard mitigation when multiple air hazards are detected; and select at least one air hazard mitigation measure if the air hazard data exceeds an air hazard threshold for a relevant air hazard and direct an air hazard mitigation device to perform a selected at least one air hazard mitigation measure, wherein the at least one air hazard mitigation measure is designated by an action algorithm stored within the memory;

wherein the action algorithm and the prioritization algorithm are configured to designate and store appropriate air hazard mitigation measures for the detected air hazard;

wherein the selection of a particular prioritization algorithm and/or particular action algorithm is configured to be modified based on a selected operating mode.

20. The method of claim 10, further comprising periodically assessing, with the central controller, whether the central controller can detect and communicate with each of the at least one air hazard sensor, the at least one environmental condition monitor, and the at least one air hazard mitigation device.

* * * * *